US006698207B1

(12) United States Patent
Wiebe et al.

(10) Patent No.: US 6,698,207 B1
(45) Date of Patent: Mar. 2, 2004

(54) FLAME-HOLDING, SINGLE-MODE NOZZLE ASSEMBLY WITH TIP COOLING

(75) Inventors: David James Wiebe, Orlando, FL (US); Michael Herbert Koenig, Oviedo, FL (US); Robert Bland, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/241,335

(22) Filed: Sep. 11, 2002

(51) Int. Cl.[7] ..... F23R 3/20
(52) U.S. Cl. ..... 60/737; 60/740
(58) Field of Search ..... 60/737, 740

(56) References Cited

U.S. PATENT DOCUMENTS 4,850,194 A * 7/1989 Fuglistaller et al.
4,850,196 A 7/1989 Scalzo et al.
5,259,184 A 11/1993 Borkowicz et al.
5,307,635 A 5/1994 Graves et al.
5,685,139 A 11/1997 Mick et al.
6,070,411 A * 6/2000 Iwai et al.
6,595,000 B2 * 7/2003 Lavie et al.

* cited by examiner

*Primary Examiner*—Ehud Gartenberg

(57) ABSTRACT

A flame-holding nozzle for a combustion turbine engine is disclosed. The nozzle includes several elongated sleeves in a substantially-concentric arrangement. The sleeves cooperatively provide distinct passageways for fluids to move through the nozzle. The nozzle includes conduits that advantageously direct fluids to designated regions of the nozzle, allowing fuel and cooling fluid to move within the nozzle without becoming commingled. Portions of the nozzle sleeves are also strategically arranged to transmit fluids in a manner that provides substantially-uniform thermal expansion, thereby eliminating the need for sliding joints or bellows arrangements.

17 Claims, 6 Drawing Sheets

FLAME-HOLDING, SINGLE-MODE NOZZLE ASSEMBLY WITH TIP COOLING

FIELD OF THE INVENTION

This invention relates generally to the field of fuel nozzles and, more particularly, to a single-mode flame holding, tip-cooled combustion engine fuel nozzle.

BACKGROUND OF THE INVENTION

Combustion engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor. The rotor produces shaft horsepower or torque; this output shaft may, in turn, be linked to devices such as an electric generator to produce electricity.

As the need for electricity rises, so to do the performance demands made upon industrial turbine combustion engines. Increasingly, these engines are expected to operate at increased levels of efficiency, while producing only minimal amounts of unwanted emissions. Various approaches have been undertaken to help achieve these results.

One approach has been to utilize multiple single-mode nozzles arranged in discrete groups to form a so-called "dry, low-$NO_x$" (DLN) combustor. DLN combustors typically provide lowered amounts of unwanted emissions by lowering the burning temperature and by premixing the fuel and air and by providing independent flows of fuel to two or more discrete groups or "stages" of nozzles, with each stage contributing in a different manner to the overall combustion process. Two common gaseous fuel stages found in DLN arrangements are the "pilot" and "main" stages. Quite often, the pilot stage is a fuel-rich "diffusion" nozzle capable of holding a flame. Diffusion-type nozzles are quite stable, but they unfortunately provide a source of combustion hot spots that lead to the formation of $NO_x$ emissions. To keep these unwanted emissions at a minimum, typically only one diffusion nozzle is used in a given combustor. The main stage nozzles, therefore, typically operate in a "premix" mode, producing a mixture of fuel and air that burns through interaction with other flames, such as the fuel-rich flame produced by the pilot stage. Although this arrangement produces relatively-low levels of $NO_x$ emissions when compared to diffusion-only combustors, the presence of only one flame-holding nozzle reduces operational flexibility. This limitation, combined with the $NO_x$ emissions produced by the pilot nozzle diffusion flame, make traditional DLN combustors unsuitable for many settings.

In an attempt to reduce $NO_x$ emissions even further and to provide increased operational flexibility, combustors that employ flame-holding nozzles capable of operating in a premix mode have been developed. Typically, these combustors employ at least one pilot nozzle capable of providing a diffusion flame to initiate startup combustion. Multiple flame-stable nozzles capable of operating in a premix mode are included to support combustion during the majority of remaining operating conditions. While the use of flame-holding premix nozzles advantageously reduces $NO_x$ emissions levels and may provide increased operational flexibility, efforts to produce such a nozzle have met with difficulty. This type of nozzle must not only produce a controlled stream of mixed fuel and air, it must also provide tip cooling to avoid melting as combustion temperatures rise to meet increased demands for power output. Flame-holding diffusion nozzles also face tip cooling and fuel dispersion requirements and present similar difficulties. Nozzles attempting to provide these characteristics have succeeded to varying degrees. For a variety of reasons, however, the practical difficulties imposed by meeting these requirements simultaneously has resulted in nozzles that are prone to leaks, are not reliable, and which may actually reduce efficiency due to losses generated by a large number of components.

Accordingly, there exists a need for a flame-stable nozzle that provides tip cooling and controlled fuel dispersion in a simplified manner. The nozzle should transmit cooling air in a passive manner through a dedicated passage that eliminates the need for complex valve arrangements, thereby reducing costs and increasing reliability. The nozzle should also include discrete fluid-guiding regions that are sealed in a leak-resistant manner without the reliance upon bellows or slip fits.

SUMMARY OF THE INVENTION

The instant invention is a single-mode, flame-holding nozzle for a gas turbine combustion engine that provides passive tip cooling and controlled fuel dispersion. The nozzle includes several elongated sleeves that cooperatively form discrete passageways adapted to transmit fluids through the nozzle. The nozzle includes conduits that allow fuel and cooling air to reach designated fuel and cooling passageways without mixing. This arrangement advantageously ensures that air used to cool the nozzle does not become flammable, thereby reducing the chances of unwanted flashback occurrences. Portions of the nozzle sleeves are also strategically arranged to transmit fluids in a manner that provides substantially-uniform thermal expansion, thereby reducing the need for sliding joints or bellows arrangements.

Accordingly, it is an object of the present invention to provide a single-mode combustor nozzle having tip cooling and controlled flame-holding capabilities.

It is another object of the present invention to provide a single-mode combustor nozzle that includes a dedicated cooling fluid passageway that eliminates the need for complex valve and manifold arrangements.

It is another object of the present invention to provide a single-mode combustor nozzle that includes discrete fluid-guiding regions that are sealed without the need for sliding joints or bellows arrangements.

Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

DETAILED DESCRIPTION OF THE INVENTION

Figure 1:
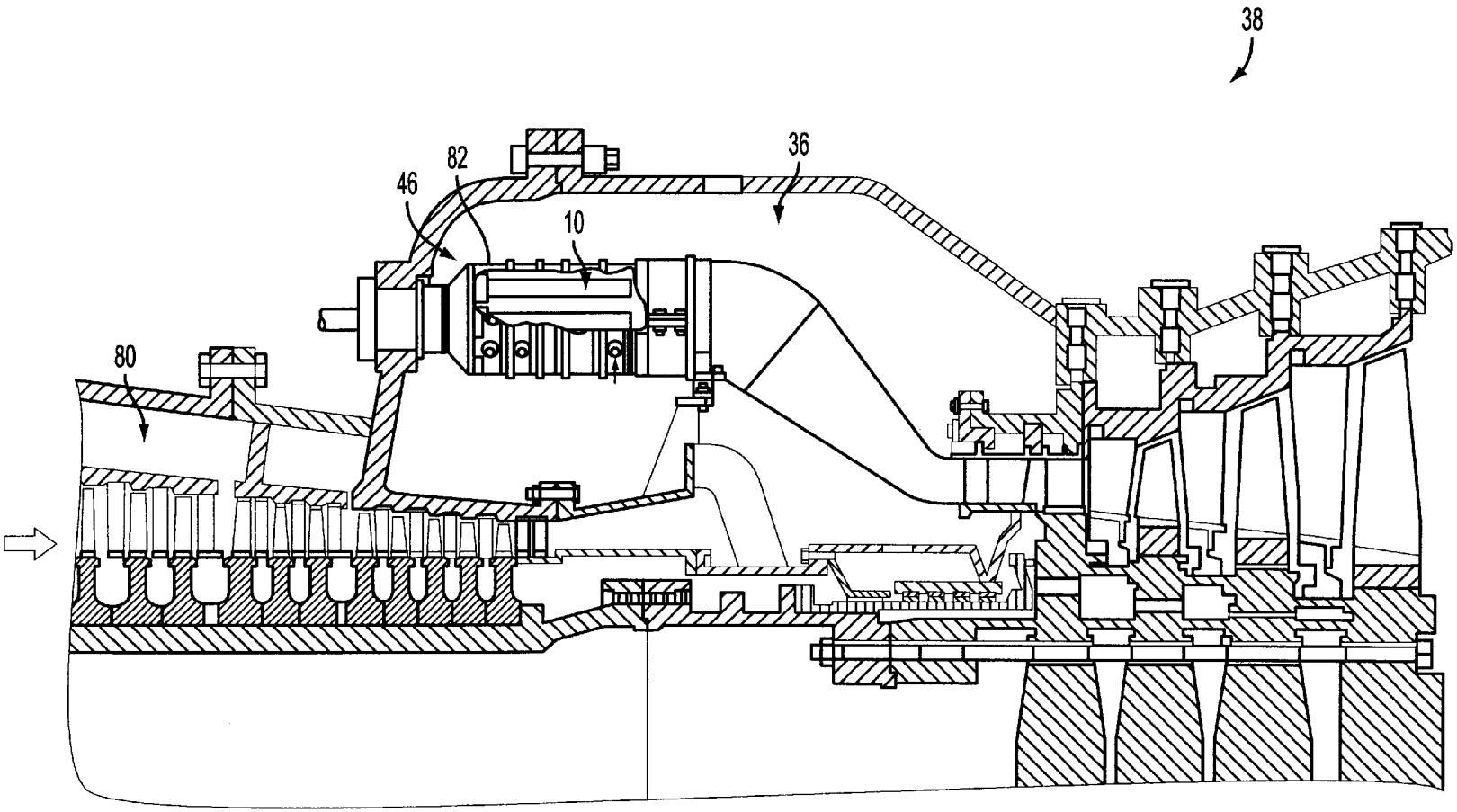
FIG. 1 is a side elevation of a combustion engine employing the nozzle of the present invention.

Reference is now made in general to the Figures, wherein the nozzle 10 of the present invention is shown. As shown in FIG. 1, the nozzle 10 of the present invention is especially suited for use in a combustion system 36 using nozzles that operate in a single-mode, but could have application as a dual-mode nozzle, as well. By way of overview, and with additional reference to FIG. 2, the nozzle 10 resembles an elongated cylinder having several substantially-concentric tubes 12, 14, 16, 18 that cooperatively form a collection of annular chambers 20, 22, 24, 26 which facilitate controlled flow of fluids through the nozzle. The nozzle 10 is characterized by a first end 40 and an opposite second end 42, with fluids flowing generally from the first end to the second end during operation. The nozzle 10 also includes conduit groups 28, 30 that advantageously allow fuel 32 and tip cooling air 34 to reach designated passageways within the nozzle. More particularly, the first conduit group 28 allows fuel 32 to move from the second passageway 22 into the first passageway 20, to interact with air 52 located therein. The second conduit group 30 beneficially allows cooling air 34 to reach the third passageway 24 from a location radially outward of the fuel-containing second passageway 22, without allowing fuel 32 to contaminate the cooling air. Third passageway exits 60 allow cooling air 34 to leave the third passageway exits 60 and cool the nozzle second end 42. The conditions within an associated combustor 46 at the nozzle second end 42 ensure the flame is self-stable. As is understood in the art, this generally means that the fuel/air mixture in passage 20 has sufficient velocity to prevent ignition upstream of the tip, and has an adequate fuel/air ratio to provide stable combustion in the lower velocity flame region immediately downstream of the tip. The nozzle 10 will now be described in further detail.

Figure 6:
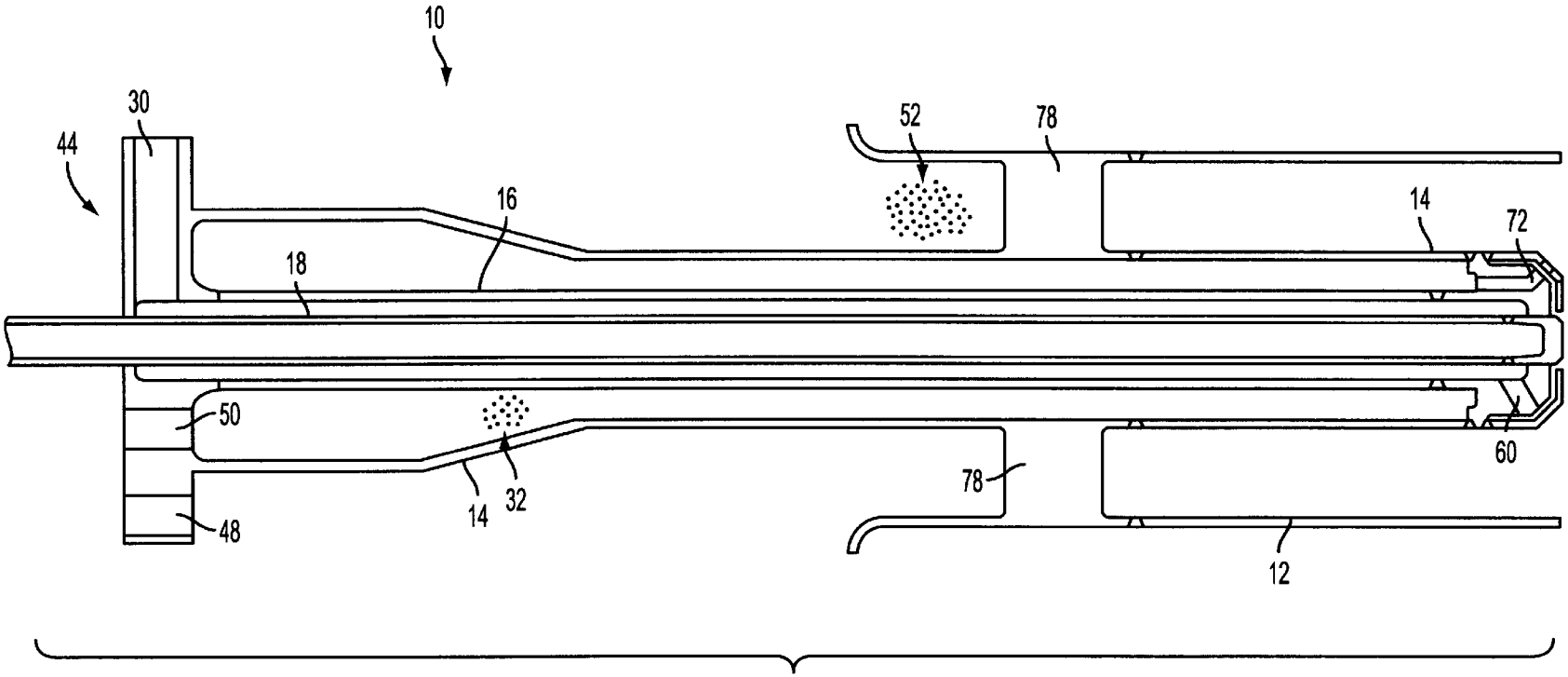
FIG. 6 is a side sectional view of an alternate embodiment of the nozzle shown in FIG. 2.

In one embodiment, the nozzle 10 of the present invention is especially suited for use as a flame-holding main nozzle in a premix mode, where premix fuel 32 travels from a source of fuel (not shown) through apertures 50 at the upstream end 40 of the nozzle 10 and enters a nozzle second passageway 22. The fuel 32 flows through the second passageway 22 and travels into the first passageway 20, where it forms a flammable mixture with air 52 located therein. The flammable mixture flows toward the nozzle second end 42; combustion may be initiated by an igniter 76 that is positioned in a nozzle inner passageway 26 or located remotely. Other components, including a diffusion nozzle (as seen in FIG. 6) may also be used to initiate combustion, if desired. If the inner passageway 26 is not used to hold an igniter 76, the inner passageway may be plugged or adapted to transmit a fluid to the nozzle tip 42. Tip cooling air 34 passes through the third passageway and prevents tip melting, as described below.

Figure 2:
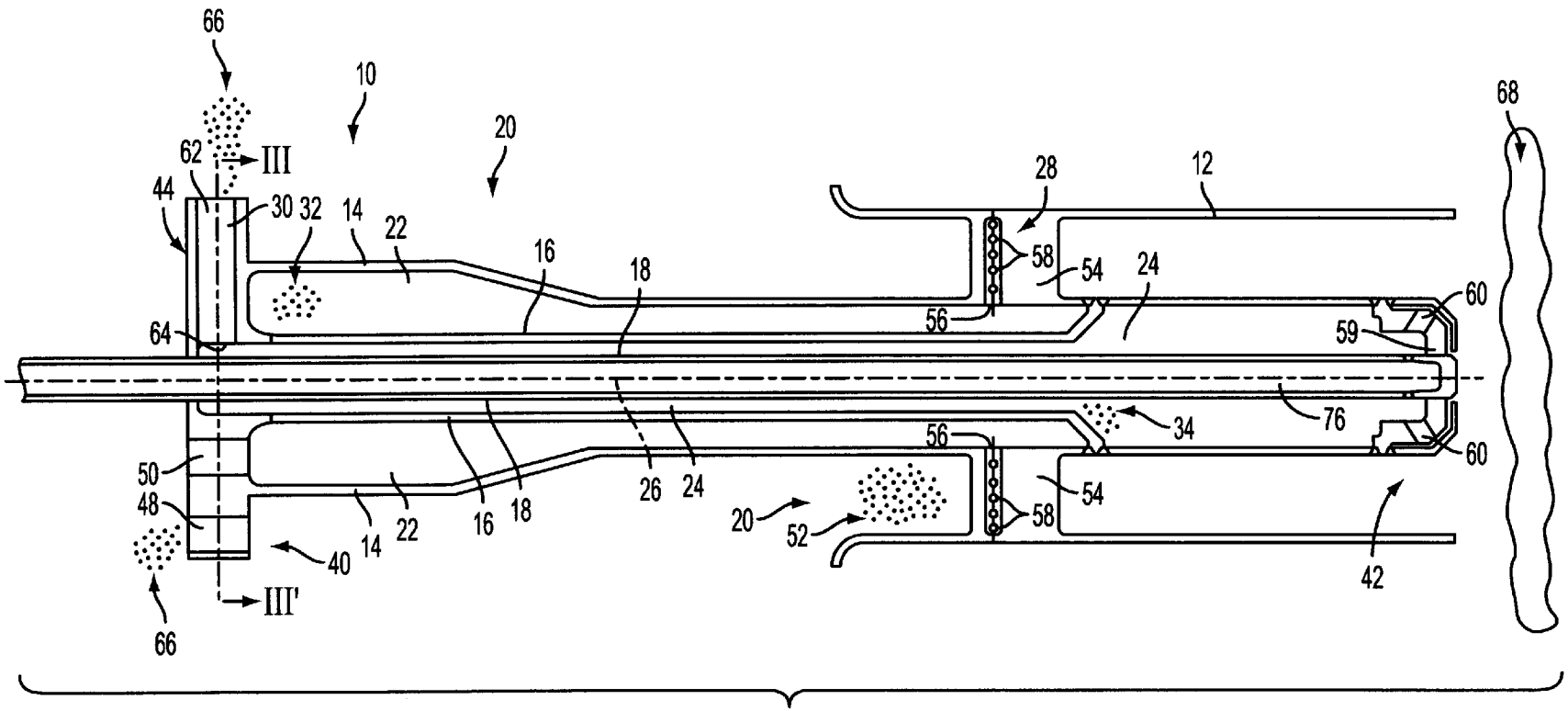
FIG. 2 is a side sectional view of the nozzle of the present invention.
Figure 3:
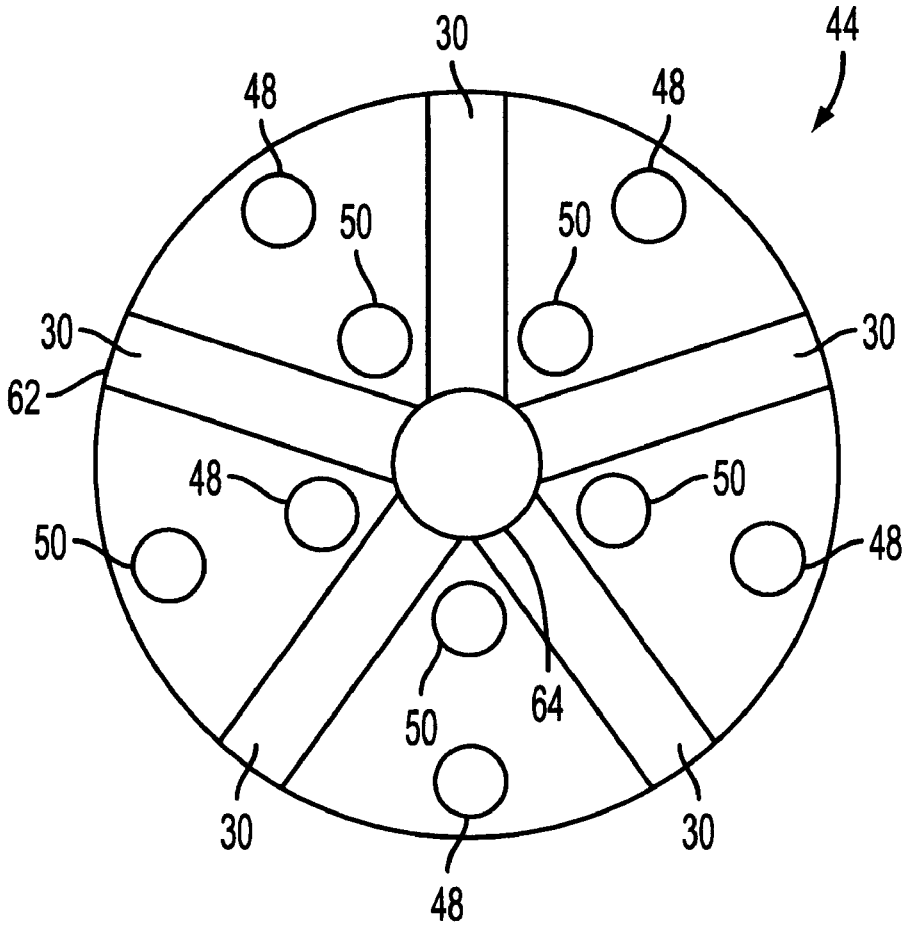
FIG. 3 is an end view of the mounting flange shown in FIG. 2, taken along cutting line III—III.

With particular reference to FIGS. 2 and 3, the nozzle 10 includes a mounting flange 44 that helps secure the nozzle within a combustor 46 of a selected gas turbine combustion system 36. The mounting flange 44 includes two groups of apertures 48, 50 that allow premix air 52 and premix fuel 32, respectively, to pass through the flange and enter corresponding passageways, or chambers, formed by the nozzle sleeves 14,16,18. More particularly, the first set of apertures 48 facilitates entry of premix air 52 into the nozzle first passageway 20. Similarly, the second set of apertures 50 allows premix fuel 32 to enter the nozzle second passageway 22.

Figure 5:
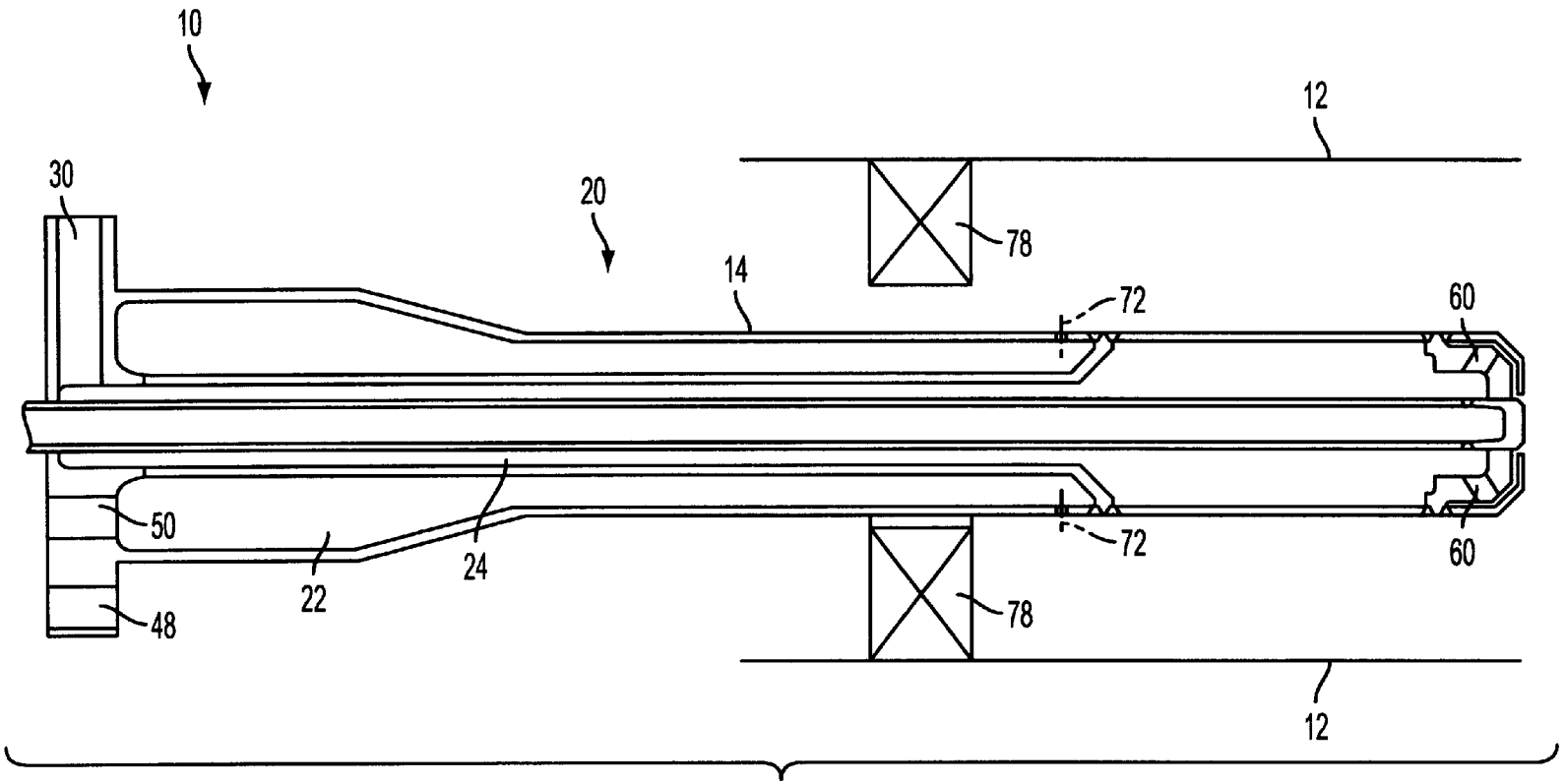
FIG. 5 is a side sectional view of the nozzle shown in FIG. 2 having alternate flow conditioning elements.

With continued reference to FIGS. 2 and 3, conduits 28,30 beneficially allow premix fuel 32 and cooling air 34, respectively, to flow between portions of the nozzle 10 without becoming commingled. The first group of conduits 28 includes fuel injection members 54 that are each characterized by an entrance 56 in fluid communication with the second passageway 22 and an exit 58 in fluid communication with the first passageway 20. With continued reference to FIG. 2, the fuel injection members 54 are hollow and include a group of exit holes 58. With this arrangement, the fuel injection members 54 transmit premix fuel 32 into the first passageway 20, where it mixes with premix air 52 and creates a flammable mixture of fuel and air. The fuel injection members 54 may be adapted condition flow within the first passageway 20 by, for example, having a substantially-airfoil-shaped cross-section. As seen in FIGS. 5 and 6, other flow conditioning elements, such as discrete swirler vanes 78, or other suitable components, may also be provided as desired. The flow conditioning elements 78 may be connected to either or both of the nozzle first sleeve 14 and/or to a nozzle outer wall 12.

It is noted that the first set of conduits 28 need not include fuel injection members 54, and may take a variety of forms that permit fuel to travel from the second passageway 22 to the first passageway 20. For example, as shown in FIG. 5, simple exit apertures 72 disposed within the first sleeve 14 may be used. It is further noted that the fuel 32 may exit the second passageway 22 from a variety of axially-different locations. It is also noted that the outer wall 12 is not required for operation; the first passageway 20 may be bounded by the first sleeve 14 and a supplemental sleeve or partition, such as the combustor wall 82 or other suitable boundary, as seen in FIG. 1.

As noted above, the second group of conduits 30 provide dedicated paths through which air 34 reaches the third passageway 24. As will be described in more detail below, the air 34 in the third passage acts as cooling air, flowing downstream and through third passageway exits 60 to cool the nozzle tip or second end 42.

Each of the conduits 30 in the second conduit group includes an entrance 62 in fluid communication with a source of cooling air (such as a compressor 80 coupled with the associated combustion turbine engine 38, seen in FIG. 1) and an opposite exit 64 in fluid communication with the third passageway 24. In one embodiment, the second conduit entrances 62 are in fluid communication with compressor discharge air 66, and the second group of conduits 30 directs a portion of the compressor discharge air into the third passageway 24 to, as noted above, cool the nozzle second end 42.

With particular reference to FIG. 3, each of the cooling air conduits 30 is oriented radially within the mounting flange 44. With continued reference to FIG. 3, the cooling fluid conduits 30 lie between the premix air and fuel apertures 48, 50, which extend longitudinally through the mounting flange 44. In keeping with the objects of the invention, this arrangement advantageously allows the entrances 62 of the cooling fluid conduits 30 to be located radially-outboard of the fuel 32 and the cooling fluid conduit exits 64 to be located radially-inboard of the premix fuel. As a result, the cooling fluid conduit entrances 62 are located upstream of the locations where fuel 32 joins the compressor discharge air 66. This arrangement advantageously allows one source of air 66 to provide air for several purposes, while safely ensuring that the air 34 used for cooling is fuel-free and not flammable.

As seen in FIG. 2, sliding interface 59 permits relative motion at the second end of the nozzle 42, thereby accommodating thermal growth differences during operation. With this arrangement, air, and not fuel, flows within passageway 34. This advantageously ensures that fluid which may emanate from the interface 59 is not flammable.

Figure 4:
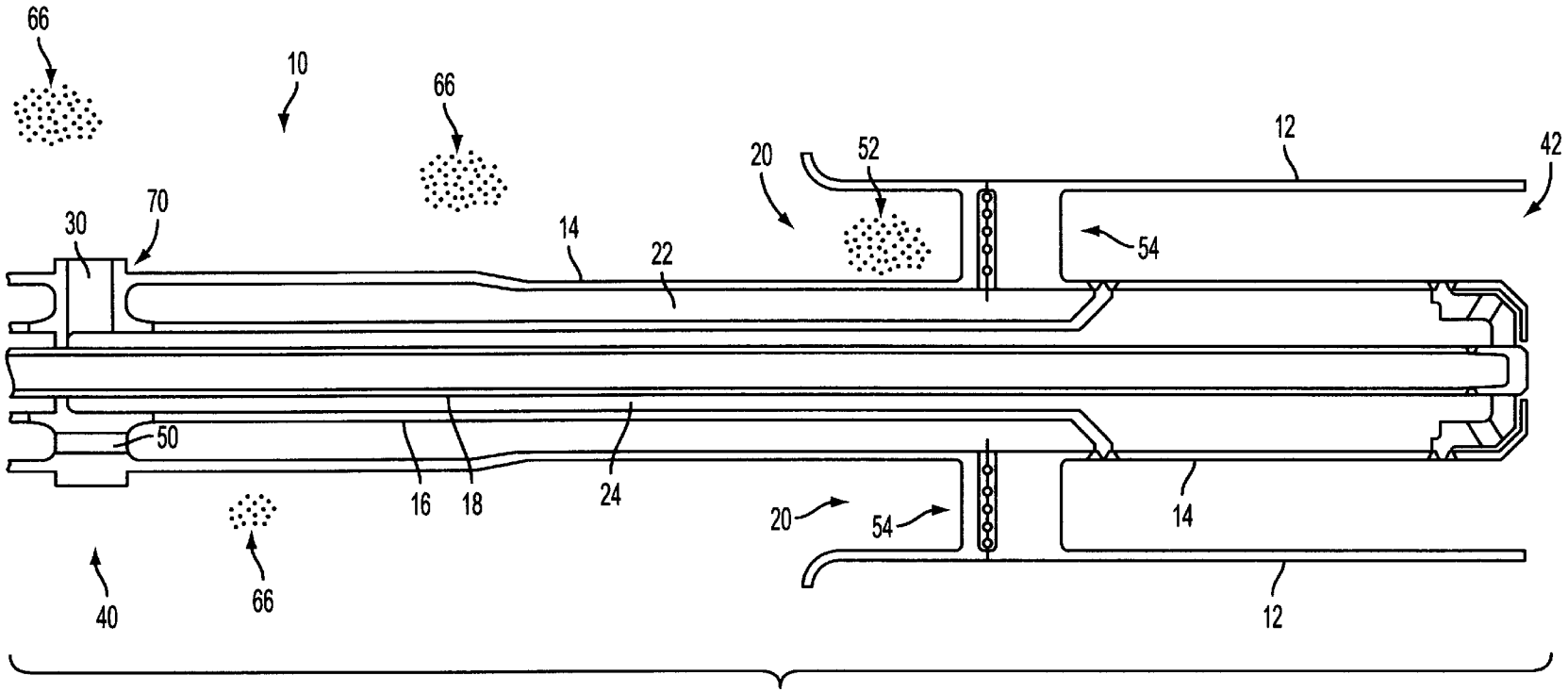
FIG. 4 is a side sectional view of the nozzle shown in FIG. 2, having an alternate cooling fluid transfer arrangement.

It is noted that the cooling fluid conduits 30 need not be radially arranged; any suitable orientation that allows the cooling air 34 to enter the third passageway 24 from a location upstream of the premix fuel 32 would suffice. Radial arrangement of the cooling fluid conduits 30 does, however, provide enhanced manufacturability. It is also noted that the cooling fluid conduits 30 need not be located in a mounting flange 44; other locations may be used as desired. For example, as shown in FIG. 4, the second group of conduits 30 may extend through a component that does not support the nozzle 10, such as a fluid supply ring or hub 70. It is also noted that compressor discharge air 66 substantially surrounds the nozzle first end 40, and that such air may enter the first passageway by travelling around the nozzle first end and flowing between the outer wall 12 and first sleeve 14, thereby eliminating the need for the first group of apertures 48.

With continued reference to FIG. 2, the cooling fluid passageway exits 60 are in fluid communication with the first passageway 20, and a pressure drop across the first passageway helps move the flow of cooling air 34 through the third passageway 24/exit 60. The pressure drop in the first passageway 20 may be increased through, among other methods, increasing turbulence and/or velocity in the first passageway 20. With this arrangement, the nozzle 10 of the present invention provides a passive tip cooling system that employs a dedicated, air-only cooling fluid which eliminates the need for flows of purge fluid or fuel-blocking members.

Although the nozzle 10 of the present invention has been described as especially suited for use in a premix mode, the nozzle could also be used in a diffusion mode, wherein fuel 32 would be released through fuel exit apertures 72 located adjacent the nozzle second end 42. An example of such an arrangement is shown in FIG. 6.

It is noted that while the nozzle 10 of the present invention has been described as diverting a portion of the compressor discharge air 66 into the third passageway 24 to provide cooling air 34, other arrangements may be used. For example, the entrances 62 of the cooling fluid conduits 30 may be in fluid connection with other sources of cooling air, including a cooling air manifold (not shown). It is also noted that cooling air 34 may be motivated through the third passageway 24 by a pump (not shown) or other suitable flow-inducing components.

During operation, the first and second sleeves 14,16 are each exposed to compressor discharge air 66 and premix fuel 32. As a result, the thermal expansion exhibited by the first sleeve 14 is substantially, if not identically, the same as the thermal expansion exhibited by the second sleeve 16. With this arrangement, the first sleeve 14 may advantageously be connected to the second sleeve 16 in a rigid manner, thus eliminating the need for flexible connections, such as bellows, or slip-fit arrangements. This advantageously makes the nozzle 10 more reliable, increases the nozzle life span, and makes the nozzle less likely to leak.

It is to be understood that while certain forms of the invention have been illustrated and described, it is not to be limited to the specific forms or arrangement of parts herein described and shown. It will be apparent to those skilled in the art that various, including modifications, rearrangements and substitutions, may be made without departing from the scope of this invention and the invention is not to be considered limited to what is shown in the drawings and described in the specification. The scope if the invention is defined by the claims appended hereto.

What is claimed is:

1. A flame-holding fuel nozzle for a combustion engine, said nozzle comprising:

an elongated first sleeve characterized by an upstream end and an opposite downstream end;

a second sleeve disposed radially inward of said first sleeve, said first and second sleeves defining a fuel passageway therebetween, said fuel passageway including an inlet and an exit, said inlet being adapted for fluid communication with a source of fuel;

a third sleeve disposed radially inward of said second sleeve, said second and third sleeves defining a cooling fluid passageway therebetween, said cooling fluid passageway having an inlet and an exit; and a cooling fluid conduit adapted to fluidly connect said cooling fluid passageway with a source of cooling fluid, said conduit having a conduit entrance located upstream of said fuel passageway exit and a conduit exit in fluid communication with said cooling fluid passageway inlet, whereby said cooling fluid conduit, said cooling fluid passageway, and said fuel passageway cooperatively ensure that cooling fluid passing through said cooling fluid passageway exit is substantially fuel-free during operation.

2. The flame-holding fuel nozzle of claim 1, wherein said cooling fluid is air discharged from a compressor operatively associated with said combustion engine.

3. The flame-holding fuel nozzle of claim 1, wherein said first sleeve cooperatively forms an outer passageway with an outer boundary member spaced radially outward from said first sleeve, said outer passageway being in fluid communication with said fuel passageway exit, said outer passageway including an upstream entrance and a downstream exit, said entrance being adapted for fluid communication with a source of air.

4. The flame-holding fuel nozzle of claim 3, wherein said outer boundary member is an outer wall disposed around a portion of said first sleeve.

5. The flame-holding fuel nozzle of claim 3, further including a flow conditioning element disposed within said outer passageway, said flow conditioning element being adapted to at least partially produce a pressure drop.

6. The flame-holding fuel nozzle of claim 3, wherein said cooling fluid is motivated through said cooling fluid passageway substantially by a pressure drop between said cooling fluid conduit entrance and said cooling fluid exit.

7. The flame-holding fuel nozzle of claim 6, wherein said cooling fluid includes air discharged from a compressor operatively associated with said combustion engine.

8. The flame-holding fuel nozzle of claim 6, wherein said pressure drop is at least partially induced by a flow conditioning element disposed within said outer passageway.

9. The flame-holding fuel nozzle of claim 6, wherein said outer wall and said first sleeve are oriented to at least partially induce said pressure drop.

10. The flame-holding fuel nozzle of claim 9, wherein said pressure drop is at least partially induced by a flow conditioning element disposed within said outer passageway.

11. The flame-holding fuel nozzle of claim 3, wherein:

said first sleeve and said second sleeve is each characterized by a first surface and an opposite second surface, each of said first surfaces being arranged for contact with a first fluid having a first temperature and each of said second surfaces being arranged for contact with a second fluid having a second temperature, wherein said contact produces substantially-equal thermal expansion in said first and second sleeves.

12. The flame-holding fuel nozzle of claim 11, wherein:

said first and second sleeves are joined together in a rigid relationship, whereby said substantially-equal thermal expansion facilitates said rigid relationship.

13. The flame-holding fuel nozzle of claim 3 further comprising a mounting flange adjacent an upstream end of said nozzle, said cooling fluid conduit being disposed in said mounting flange.

14. The flame-holding fuel nozzle of claim 13 wherein said cooling fluid conduit is oriented in a substantially-radial relationship with respect to a longitudinal axis of said nozzle.

15. The flame-holding fuel nozzle of claim 3 further comprising a fluid transfer member adjacent an upstream end of said nozzle, said cooling fluid conduit being disposed in said fluid transfer member.

16. The flame-holding fuel nozzle of claim 15 wherein said cooling fluid conduit is oriented in a substantially-radial relationship with respect to a longitudinal axis of said nozzle.

17. A flame-holding fuel nozzle for a combustion engine, said nozzle comprising:

an elongated first sleeve characterized by an upstream end and an opposite downstream end;

a second sleeve disposed radially inward of said first sleeve, said first and second sleeves defining a cooling fluid passageway therebetween, said cooling fluid passageway having an inlet and an exit;

a third sleeve disposed radially inward of said second sleeve, said second and third sleeves defining a fuel passageway therebetween, said fuel passageway including an inlet and an exit, said an inlet adapted for fluid communication with a source of fuel; and a fuel conduit having an entrance and an exit, said entrance being in fluid communication with said fuel passageway exit, and said exit being in fluid communication with a location radially outward of said first sleeve, said fuel conduit being adapted to transmit fuel to said location radially outward of said first sleeve;

whereby said cooling fluid conduit, said cooling fluid passageway, and said fuel passageway cooperatively ensure that cooling fluid passing through said cooling fluid passageway exit is substantially fuel-free during operation.

* * * * *